United States Patent [19]

Bodine

[11] 4,434,944

[45] Mar. 6, 1984

[54] MASS (INDUCTIVE) REACTANCE VIBRATORY MILL OR CRUSHER EMPLOYING MECHANICAL DRIVE FORCE

[76] Inventor: Albert G. Bodine, 7877 Woodley Ave., Van Nuys, Calif. 91406

[21] Appl. No.: 316,045

[22] Filed: Oct. 28, 1981

[51] Int. Cl.[3] ..... B02C 2/06; B02C 19/00

[52] U.S. Cl. ..... 241/258; 166/177; 175/406; 241/208

[58] Field of Search ..... 166/177; 175/55, 406; 241/257 R, 245, 258, 262, 283, 208, 210, 202, 201, 205

[56] References Cited

U.S. PATENT DOCUMENTS 4,058,163 11/1977 Yandell ..... 166/177

FOREIGN PATENT DOCUMENTS 1191768 4/1965 Fed. Rep. of Germany ..... 175/55

677758 8/1979 U.S.S.R. ..... 241/210

OTHER PUBLICATIONS

*Sonics,* Heuter & Bolt, 1/55, pp. 9–21.

*Primary Examiner*—Mark Rosenbaum

[57] ABSTRACT

A mill or crusher useful for crushing and grinding material employing mechanical vibratory drive force at a sonic frequency. A drive shaft having orbiting eccentric weight means fixedly attached thereto and having freedom of motion both rotationally and laterally is rotatably driven by a drive motor to generate quadrature related vibratory force components in the drive shaft. Rotatably supported on the drive shaft by means of suitable bearings is a driving member having mass (inductive) inertia in said sonic frequency range. A "slave" member is freely supported on vibration isolation members in external concentricity with the driving member so that it is effectively in a "floating" condition, thus presenting a mass reactance in said sonic frequency range. Material to be milled or crushed is fed in the gap between the driving member and the free-floating "slave". Cycloidal force is delivered from the shaft to the driving member to precess or roll around on the inside wall of the free floating slave member. Vibratory energy developed in this gap effects grinding or crushing action on the material fed therebetween.

13 Claims, 6 Drawing Figures

MASS (INDUCTIVE) REACTANCE VIBRATORY MILL OR CRUSHER EMPLOYING MECHANICAL DRIVE FORCE

SPECIFICATION

This invention relates to relatively high frequency mechanical vibratory crushing or milling or liquid cavitation processing, and particularly to a device employing eccentric weight masses for generating vibratory compression and expansion energy which is applied along with shear and radial force components on work material or fluid fed to a gap between an inductively excited vibratory driving member and a free floating slave member concentric with the driving member.

The use of vibratory energy for crushing and grinding material is well known in the art and is described in my U.S. Pat. Nos. 3,284,010; 3,682,397; 3,473,741; 3,414,203, 3,131,878; and 3,429,512. The prior art systems described in these patents generally employ inertial members forming jaws between which the material to be crushed or comminuted is fed, with one or both of these jaw members being independently vibratorily driven by a resonant vibration system employing a mechanical oscillator. An improvement over these prior art systems in the form of a cycloidal sonic mill is described in my co-pending application Ser. No. 228,225, filed Jan. 26, 1981. The advantages of crushing action employing a whirling or rotary type wave action (two degrees of freedom in quadrature) which is transmitted cycloidally to develop radial force combined with shear force, is pointed out in my aforementioned application Ser. No. 228,225. In the device of this prior application, a resonant vibration system is employed wherein the material to be ground is fed between a first mass member which is cycloidally driven against a second mass member.

The device of the present invention is a modification of the device described in my aforementioned application Ser. No. 228,225, which involves a substantially simpler and more economical construction and wherein the resulting force of the crushing or grinding action is a three factor function of the direct interaction between a vibratory inductive driving force and the inertial mass or inductive reactance of a free floating slave member and the coupling characteristics of the material being ground or crushed.

It has been found most helpful in analyzing the operation of the device of this invention to analogize the acoustically vibrating circuit involved to an equivalent electrical circuit. This sort of approach to analysis is well known to those skilled in the art and is described, for example, in Chapter 2 of Sonics, by Hueter and Bolt, published in 1955 by John Wiley and Sons. In making such an analogy, force F, is equated with electrical voltage E; velocity of vibration u, is equated with electrical current i; mechanical compliance $C_m$, is equated with electrical capacitance $C_e$; mass M is equated with electrical inductance L; mechanical resistance (friction) $R_m$, is equated with electrical resistance R; and mechanical impedance $Z_m$ is equated with electrical impedance $Z_e$.

Thus, it can be shown that if a member is elastically vibrated by means of an acoustical sinusoidal force $F_o$ sin $\omega t$, ($\omega$ being equal $2\pi$ times the frequency of vibration), that $$Z_m = R_m + j\left(\omega M \frac{1}{\omega C_m}\right) = \frac{F_o \sin\omega t}{u} \quad (1)$$

Just as in electrical circuitry, maximum acoustical energy can be transferred from one circuit element to another where a good impedance match exists, i.e., where the two elements have like impedance. By observation of Equation 1 it can be seen that the impedance $Z_m$, is high where the force $F_o$, is high, and velocity of vibration, u, is relatively low.

The desired end results are achieved in the device of the present invention by employing a shaft member having an eccentric weight or weights fixedly attached thereto rotatably driven freely to orbit in space so as to develop a cycloidal inductive force pattern of predetermined force. Supported for relative rotation on this shaft by means of rotor bearings is a driving member which has inertia and which receives and radiates said inductive force pattern. Freely supported in external concentricity with the driving member on vibration isolator mounts is a vibratory slave member, a gap being formed between the driving member and the slave member into which the material to be ground or crushed is fed.

The predetermined vibratory exciting force generated in the shaft member is coupled through the bearings to the driving member and radiated from the driving member through the work material to the slave member. The vibratory energy develops both radial and shear vibratory forces in the work material, the shear forces effecting rolling motion of the driving member around the wall of the slave member. The sonic frequency rolling force transmitted to the slave member from the predetermined maximum force of the eccentric weights is a function both of the coupling characteristics of the work material in the gap and also the mass (inductive) inertia of the slave member. Thus, where the work material is harder, greater coupling is provided with corresponding greater grinding force being developed, while with softer materials a lesser degree of coupling is provided with a resultant lower grinding force. Also, unlike conventional constant stroke crushers, this device varies the stroke of the slave member in response to the force limiting reactance. Thus, the device is capable of automatically adjusting the grinding force and varying the orbit and stroke of the reacting members as a function of the nature of the work material and inductive reactance of the slave member, to avoid the overginding of softer material yet providing the needed grinding action where harder material is present without overstressing the machine. This is a force limited device, not a stroke limited design as in prior art machines.

It is therefore an object of this invention to provide an improved mechanical crusher or miller wherein the force of the crushing and grinding action is automatically regulated as a function of the qualities of the work material and the mass (inductive) reactances of the free elements of the device.

It is a further object of this invention to provide an improved mechanical crusher or grinder employing vibratory grinding action having both radial and shear cyclic grinding force components.

It is still a further object of this invention to provide a mechanical vibratory crusher or mill wherein the grinding action is accomplished in a gap formed between a freely vibratory and rotatably supported driving member and freely mounted slave member with the coupling between these two members being a function of the nature of the work material.

Other objects of this invention will become apparent as the description proceeds in connection with the accompanying drawings, of which:

Figure 1:
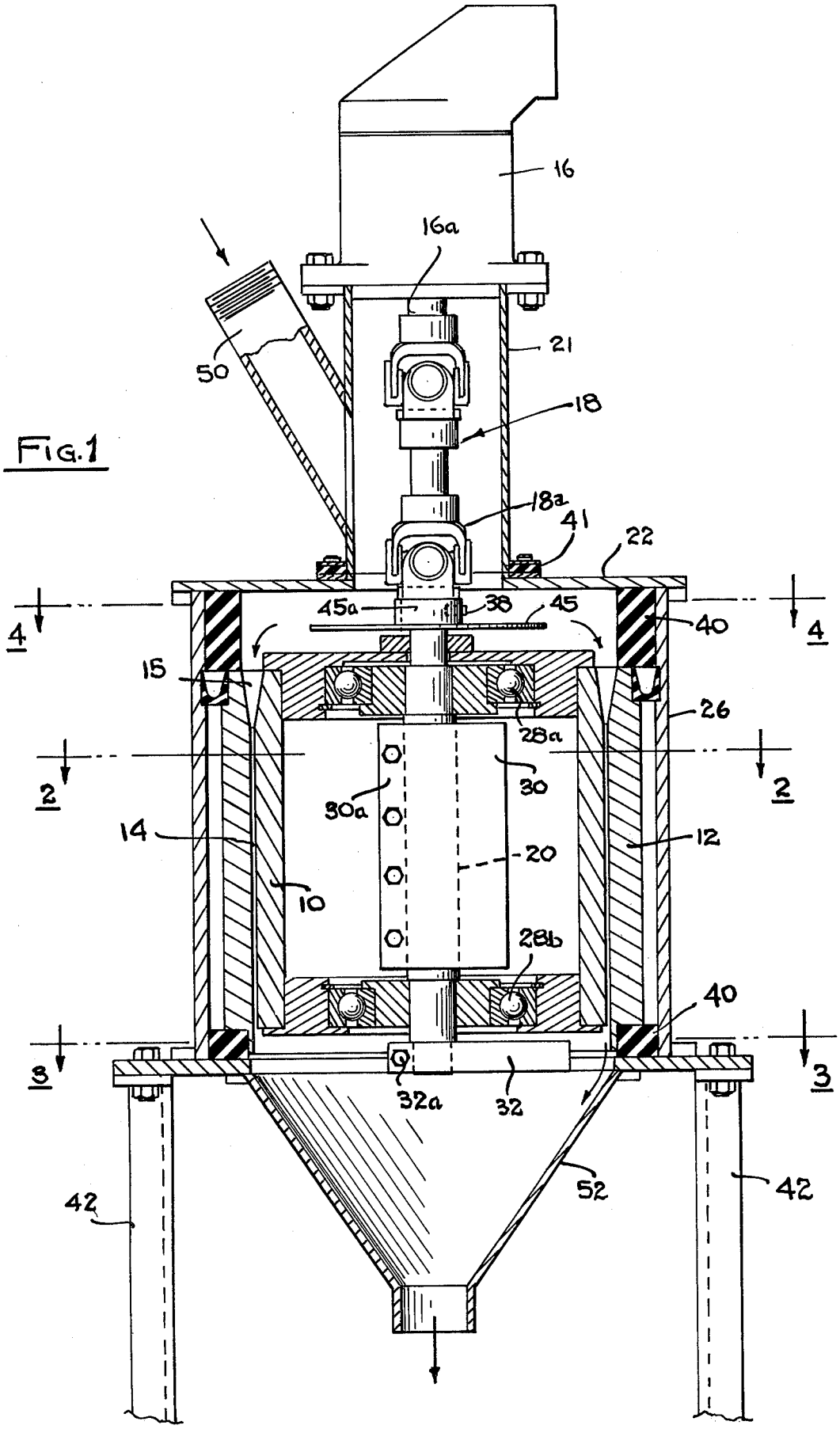
FIG. 1 is an elevational view in cross section of a first embodiment of the invention.
Figure 4:
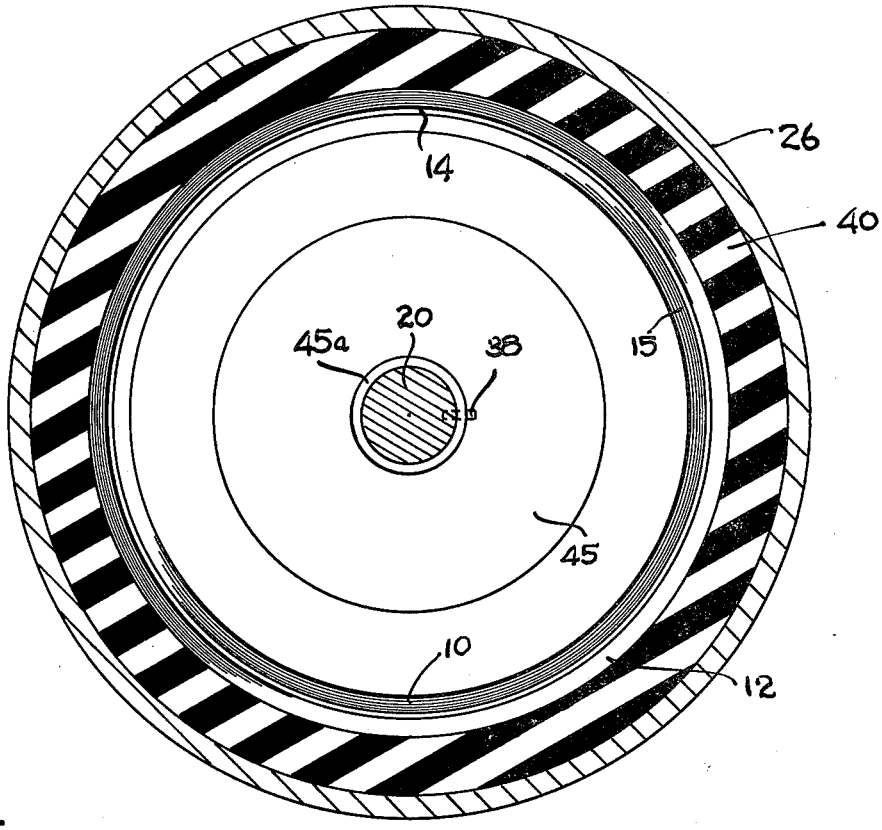
FIG. 4 is a cross-sectional view taken along the plane indicated by 4—4 in FIG. 1.
Figure 2:
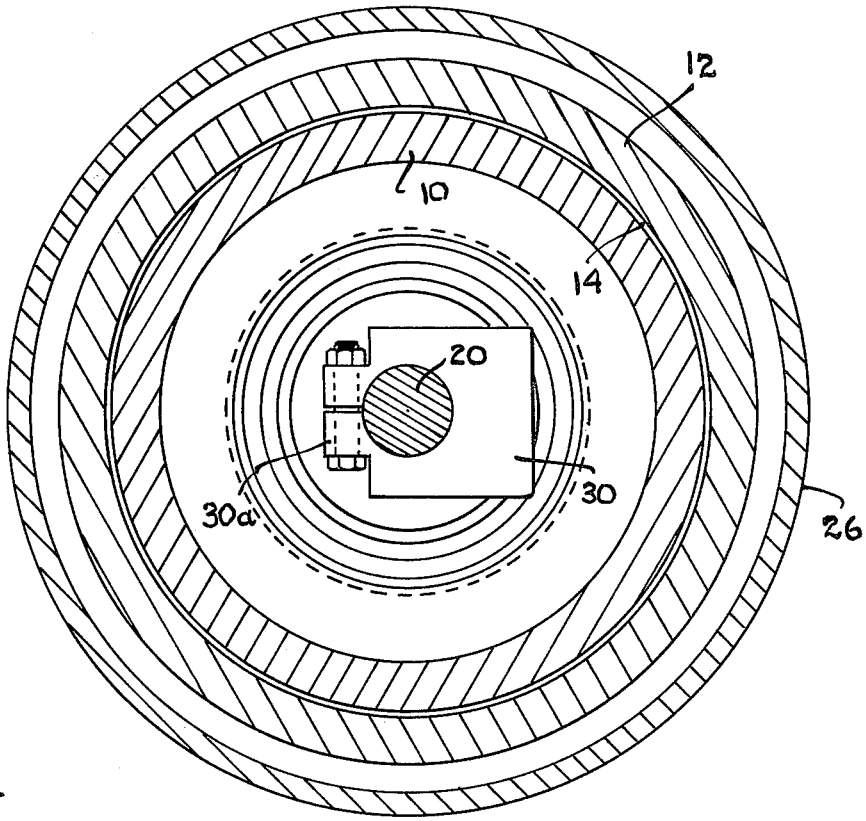
FIG. 2 is a cross-sectional view taken along the plane indicated by 2—2 in FIG. 1.
Figure 3:
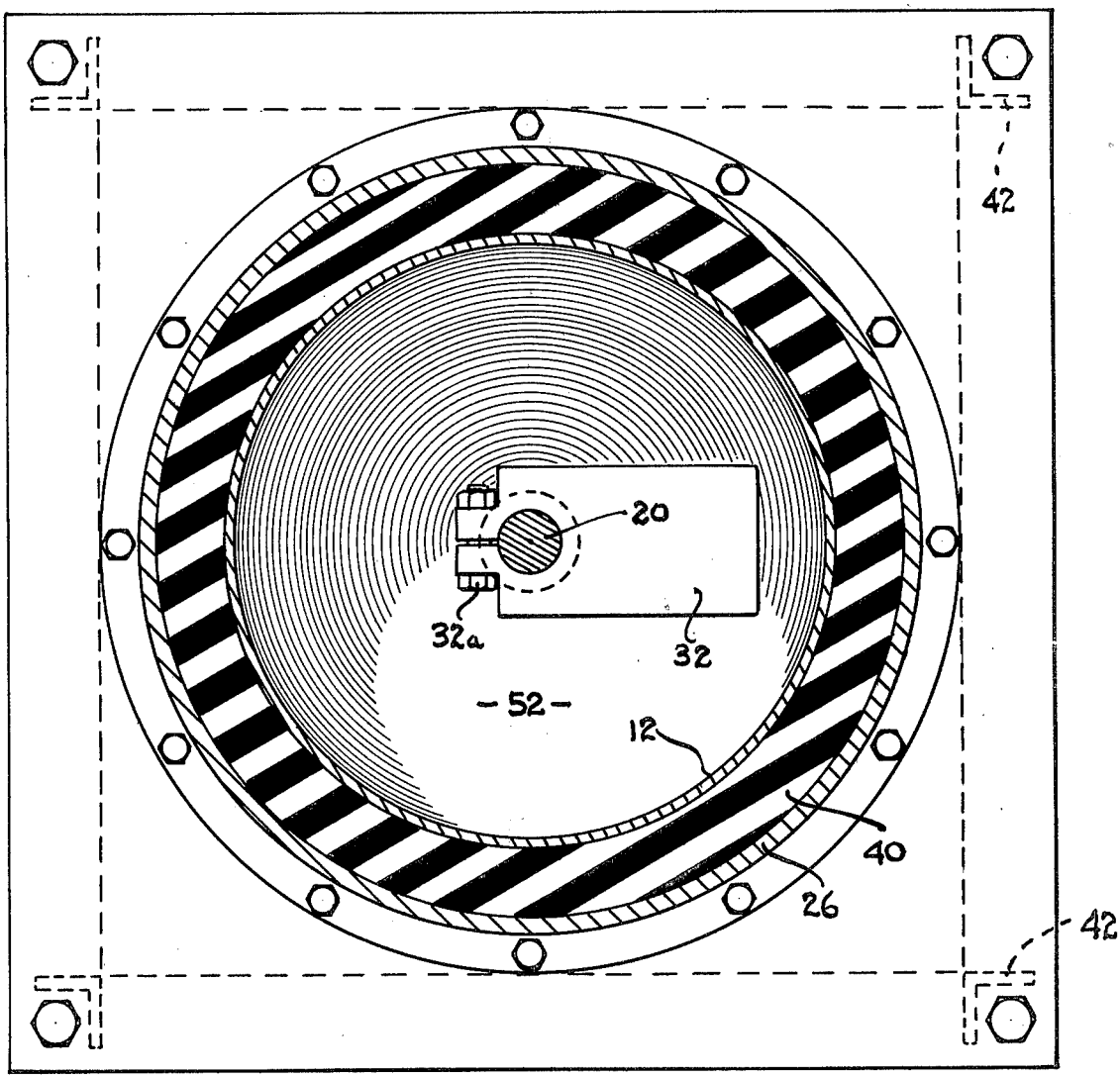
FIG. 3 is a cross-sectional view taken along the plane indicated by 3—3 in FIG. 1.

Referring now to FIGS. 1-4, a preferred embodiment of the invention is illustrated. Hydraulic motor 16 is supported by means of upper housing 21 on plate 22, which in turn is supported on main housing 26. The housing 26 which is cylindrical is supported on stand 42. The drive shaft of motor 16 is coupled through universal joint 18 to shaft 20, this shaft thus being suspended from the drive shaft 16*a* of the motor for freedom of motion laterally. A slinger disc 45 has a hub portion 45*a* which is locked to the lower end of the universal joint 18*a* by means of locking pin 38. Eccentric weight members 30 and 32 are fixedly attached to shaft 20 by suitable clamp portions thereof 30*a* and 32*a* respectively. Eccentric weight 32 is located at the bottom of shaft 20 so as to cause rocking and slinging action.

Driving member 10 is cylindrical in form and is rotatably supported on shaft 20 by means of ball bearings 28*a* and 28*b*. Cylindrical slave member 12 is freely supported in housing 26 on vibration isolation members 40 which may be of rubber, this slave member being in external concentricity with driving member 10, a gap 14 being formed between the driving and slave members. A flared circular opening 15 is formed at the top end of gap 14 to receive material to be ground or crushed. Such material is fed in through inlet spout 50 from where it travels through cylindrical upper housing member 21 to slinger disc 45 which slings or sprays the material outwardly into tapered gap 15 from where it enters annular gap 14 where the crushing and grinding operations are performed. The crushed or milled material is fed out from the bottom of gap 14 through outlet funnel 52 from which it is dispensed.

As already described, the material passed to the gap 14 is effectively ground or crushed by the sonic frequency shear and radial forces generated in the gap by virtue of the vibrational energy developed as shaft 20 is rotated in sonic frequency range, along with the eccentric weight members 30 and 32 which are attached thereto. Said frequency range is typically 20 to 200 hz.

As has already been pointed out, the coupling and transmitted force between driving member 10 and slave member 12 is affected by both the mass (inductive) reactance of slave member 12 and the character of the work material fed to gap 14; i.e., with harder material, tighter coupling will occur. Driving member 10 has its stroke varied by the coupling of the slave member. The slave member 12 tends to apply its inductance to reduce the free stroke of driver 10. Driving member 10 rolls around on slave member 12 at a rotary speed which is a function of this coupling factor and the relative diameters of members 10 and 12, the vibratory stroke of the slave member depending upon its inductive reactance and the coupling provided by the work material. Considering any vertical plane, during the first 180° of each vibration cycle the driving member acting through gap 14 tends to urge the slave member in one direction, and then in the second 180° of this vibration cycle in this plane, the driving member tends to reverse the previously urged direction of movement of the slave member, so as to greatly magnify the resulting force applied to the work material in gap 14. The free hanging universal joints 18 and 18*a* permit drive member 10 to vary its stroke. The transfer of vibrational energy from housing 26 to motor 16 is minimized by means of a circular rubber vibrational isolator mount 41 employed in connecting upper cylindrical housing portion 21 to plates 22.

Figure 5:
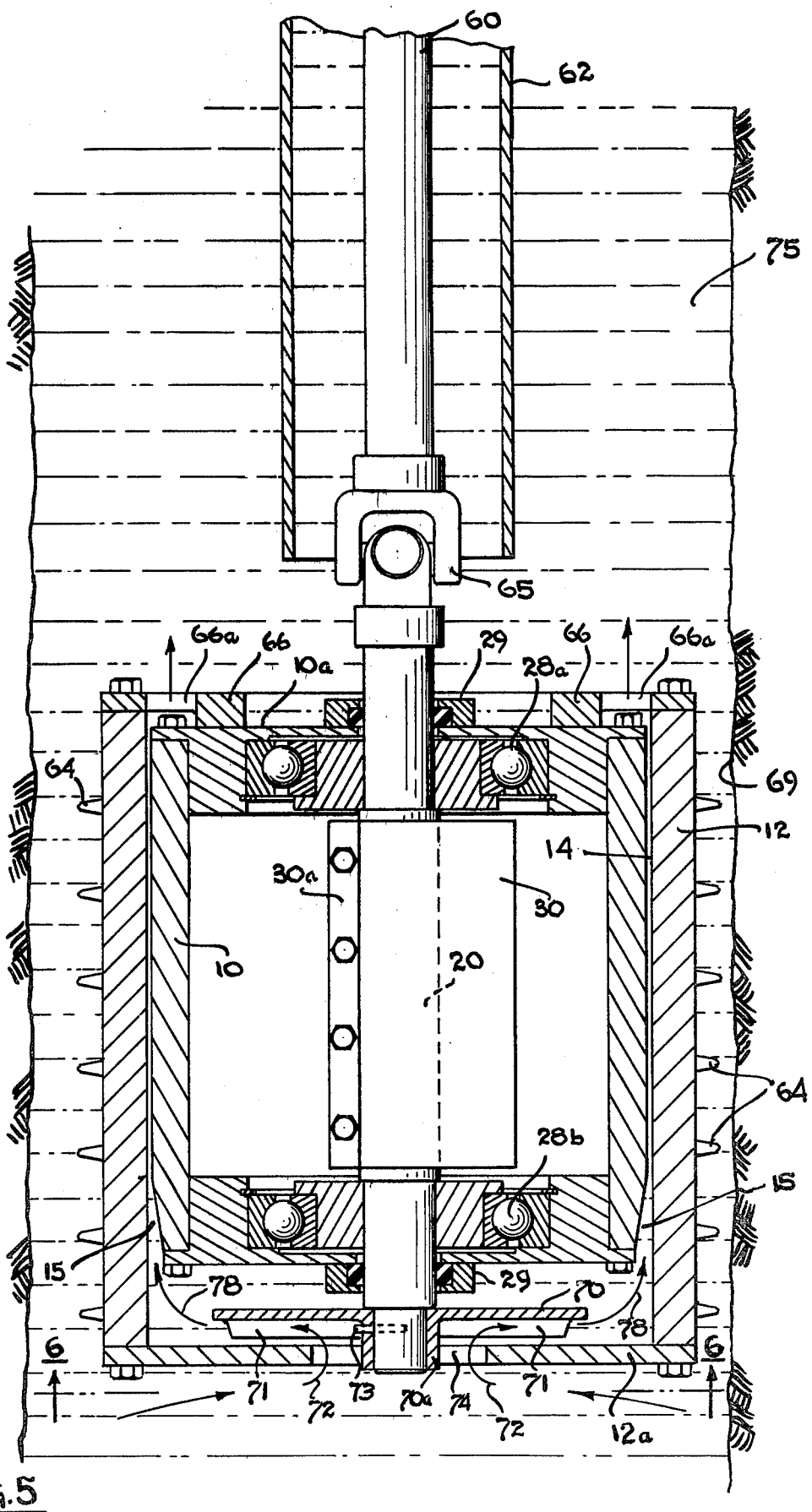
FIG. 5 is an elevational view in cross section of a second embodiment of the invention.
Figure 6:
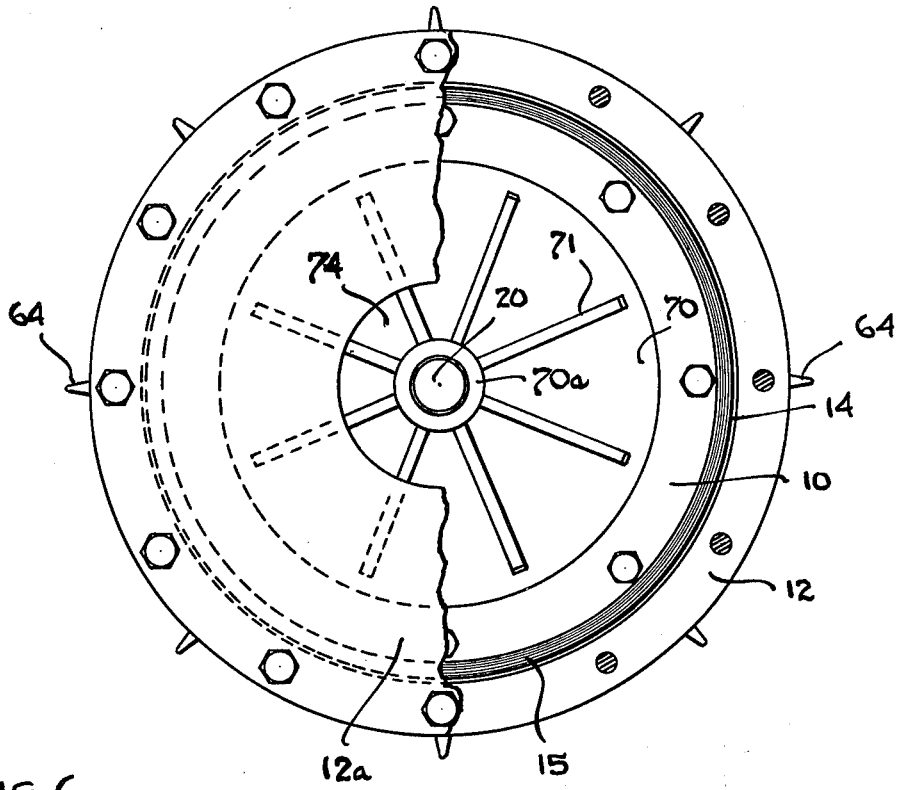
FIG. 6 is a view taken along the plane indicaed by 6—6 in FIG. 5.

Referring now to FIGS. 5 and 6, a second embodiment of the invention is illustrated, this second embodiment being adapted for use in a liquid filled well bore for the in situ mining and processing of oil shale or the like. In this second embodiment, the slave member 12 and the driving member 10 are supported within well bore 69 by means of an elongated drive shaft 60 which may comprise a rotating rod string suspended from a conventional swivel drive (not shown) at the well head.

The pipe string 62 which is also conventionally supported from the well head may be used to surround all or a portion of drive shaft 60. Shaft 20, which has an eccentric weight member 30 fixedly attached thereto by means of clamp 30*a* (as in the previous embodiment), is coupled to shaft 60 by means of U-joint 65. Driving member 10 is rotatably supported on shaft 20 by means of ball bearing assemblies 28*a* and 28*b*, seals 29 being provided to prevent the liquid from entering the space between shaft 20 and the inner walls of driving member 10.

Slave member 12 is freely supported on the top portion of driving member 10 by means of circular perforated plate 66 which abuts against the top wall 10*a* of driving member 10. Gap 14 is formed between the walls of driving member 10 and slave member 12, there being fluid communication between this gap and the perforations 66*a* of plate 66, such that fluid can freely pass from the gap into the space above slave member 12. Well bore 69 is filled with liquid 75 which may comprise an oil-water mixture.

The housing of the first embodiment is eliminated and the outer wall of slave member 12 has a plurality of drill bit inserts 64 which form hobnail type studs distributed around the outer surface of the slave member. Slave member 12 also has an annular bottom wall 12*a* which has an opening 74 formed in the central portion thereof.

A slinger disc 70 is fixedly attached to the bottom end of shaft 20 by means of pin member 73 which is fitted into the shaft through the hub portion 70*a* of the disc.

In operation, shaft 20 is rotatably driven by shaft 60 to effect the generation of vibratory force by virtue of eccentric weight member 30, in the same manner as described for the previous embodiment. Also, as for the previous embodiment, driving member 10 is caused to roll around the wall of the slave member 12 as the driving member rotates around on bearings 28*a* and 28*b* to cause shear and radial vibrational energy to be developed in rotating crescent shaped gap 14 between these two members. In addition, the vibratory energy developed in slave member 12 is transferred to drill bit studs 64 which operates to pulverize and loosen oil shale from the wall of the well bore 69. The loosened material falling down from the wall of the well into the surrounding liquid 75 (usually water) is swept upwardly as indicated by arrows 72, by virtue of the circulatory flow created by the vanes 71 of slinger disc 70 as this disc is rotatably driven by the lower end of shaft 20. Circulatory flow is directed through suction port 74 formed in wall 12*a*, from where the flow is directed radially outwardly and into the widened gap portions 15, as indicated by arrows 78.

In this manner, the material that is cut loose from wall 69 is caught up and caused to pass upwardly through treatment gap 14, where it is vibratorily ground as described in connection with the first embodiment. Oil particles which are separated from the shale rise by gravity in the liquid in the well (typically water) to the top of the well where it can be removed.

The rotation induced in member 12 submerged in the fluid tends to hold the entire assembly radially outwardly against the ever increasing diameter of the well bore (by virtue of Bernoulli effect). The well bore thus can be mined in place and enlarged to a bottle shape which can have relatively large diametered portions in its lower region. If desired, the bottom sand filled portion of a well can be reprocessed for final recovery of trace oil which may be trapped in stray grains of shale, by lowering this assembly so that the bottom suction opening 74 is submerged into the wet sand which can be sucked up by the vacuum action engendered by vane 71, so as to deliver the sand up through gap 14 in the same general manner as just described.

Liquid filled annular gap 14 as in the previously described embodiment presents a spring-like (capacitive) response to the masses (inductances) presented by masses 10 and 12 so that, if so desired, a resonance can be attained in a definitive frequency range. The frequency of resonance can be determined in the design of the device by varying the thickness of the gap 14 (liquid spring layer) and by varying the masses of members 10 and 12. Where resonant operation is employed, very large pressure swings occur in the liquid gap 14 which can include cavitation effects which aid in the comminution of the oil shale and the laundering of oil therefrom.

While the invention has been described and illustrated in detail, it is clearly to be understood that this is by way of illustration and example only and is not to be taken by way of limitation, the spirit and scope of this invention being limited only by the terms of the following claims.

I claim:

1. A vibratory mill for grinding material comprising a driving member, eccentrically weighted drive shaft means for supporting said driving member for freedom of motion rotationally about the longitudinal axis of the drive shaft means, means for suspending said drive shaft means for freedom of motion laterally with respect to said longitudinal axis, a slave member having an inside wall, means for supporting said slave member in proximity to said driving member and said slave member, means for rotatably driving said drive shaft means to generate cycloidal quadrature related vibratory force components therein, said force components causing said driving member to both roll around on and vibrate against the inside wall of said slave member, and means for feeding said material into the gap formed between the driving and slave member, both shear and radial vibratory forces being applied to said material to effect the grinding thereof.

2. The vibratory mill of claim 1 wherein said driving member and said slave member are cylindrical, said slave member being in external concentricity with said driving member, said gap formed therebetween being annular.

3. The vibratory mill of claim 1 or 2 wherein said eccentrically weighted drive shaft means comprises a drive shaft having eccentric weight means attached thereto.

4. The vibratory mill of claim 3 wherein said eccentric weight means comprises a pair of weights, one of said weights being attached to a central portion of said shaft, the other of said weights being attached to the end of said shaft.

5. The vibratory mill of claim 1 or 2 wherein the means for feeding said material into the gap comprises a slinger disc fixedly attached to said driving member and means for feeding the material to said disc.

6. The vibratory mill of claim 5 wherein the slinger disc is attached to said driving member near the top end thereof, said means for feeding the material to said disc comprising an inlet spout located above said slinger disc.

7. The vibratory mill of claim 5 wherein the material is fluid, the slinger disc being attached to said driving member near the bottom end thereof, said slinger disc having vanes on the bottom surface thereof, the means for feeding said material to said disc comprising an opening formed in the bottom of said slave member opposite said disc, said vanes generating a suction which draws the material upwardly through said opening.

8. The vibratory mill of claims 1 or 2 wherein said means for rotatably supporting said driving member on said drive shaft means comprises a pair of shaft bearings.

9. The vibratory mill of claims 1 or 2 wherein the material comprises shale oil deposits in a well filled with liquid, said slave member having studs distributed around the outer surface thereof, said studs vibratorily impacting against the wall of said well as said slave member is vibratorily excited by said driving member.

10. The vibratory mill of claims 1 or 2 wherein the means for supporting said slave member comprises a housing and resilient mount means for supporting said slave member in said housing.

11. The vibratory mill of claim 10 wherein the resilient mount means are of rubber.

12. The vibratory mill of claim 1 wherein said drive shaft means is flexible so as to permit said driving member to vary the extent of its vibratory stroke during operation.

13. The vibratory mill of claim 12 wherein said drive shaft embodies a universal joint assembly so as to provide said flexibility.

* * * * *